United States Patent [19]

Tsuchiya et al.

[11] Patent Number: 4,892,994

[45] Date of Patent: Jan. 9, 1990

[54] CURLING PREVENTION DEVICE OF THERMAL DEVELOPING MACHINE

[75] Inventors: Masaru Tsuchiya; Junichi Kohno; Ken Okauchi, all of Hino, Japan

[73] Assignee: Konica Corporation, Tokyo, Japan

[21] Appl. No.: 165,780

[22] Filed: Mar. 9, 1988

[30] Foreign Application Priority Data

Mar. 17, 1987 [JP] Japan ..... 62-61785

[51] Int. Cl.[4] ..... H05B 3/00

[52] U.S. Cl. ..... 219/216; 162/271

[58] Field of Search ..... 219/216, 469, 470, 471; 355/3 FU, 3 SH, 14 SH, 290, 311; 162/270, 271; 493/459, 461, 460

[56] References Cited

U.S. PATENT DOCUMENTS

| | | | |
|---|---|---|---|
| 1,452,438 | 4/1923 | Rise | 162/271 |
| 1,870,626 | 8/1932 | Hopkins | 162/271 |
| 2,012,953 | 9/1935 | Brunner | 162/271 |
| 2,893,053 | 7/1959 | Powell | 162/270 |
| 3,239,652 | 3/1966 | Price | 219/469 |
| 3,661,703 | 5/1972 | Shelor | 162/270 |
| 3,939,000 | 2/1976 | Arvidson, Jr. et al. | 96/87 R |
| 4,300,891 | 11/1981 | Bemiss | 162/271 |
| 4,326,915 | 4/1982 | Mutschler | 162/271 |
| 4,505,695 | 3/1985 | Billings | 162/271 |
| 4,609,517 | 9/1986 | Cason | 162/271 |
| 4,627,718 | 12/1986 | Wyer | 162/271 |

FOREIGN PATENT DOCUMENTS

| | | | |
|---|---|---|---|
| 1406975 | 6/1965 | France . | |
| 61-80148 | of 0000 | Japan . | |
| 61-108337 | of 0000 | Japan . | |
| 56-133767 | 10/1981 | Japan | 219/216 |
| 439965 | 12/1967 | Switzerland . | |
| 984701 | 3/1965 | United Kingdom . | |

*Primary Examiner*—Teresa J. Walberg

*Attorney, Agent, or Firm*—Frishauf, Holtz, Goodman & Woodward

[57] ABSTRACT

A curling prevention device of a thermal developing machine is provided at the outlet of a thermal developing and/or transfer step and thereafter with a correcting guide passage having a bend in the opposite direction to the direction of curling appearing in the step, the device being adapted to permit a thermal developing light-sensitive material to pass with a temperature of 50° C. at least at the inlet portion of the correcting guide passage.

10 Claims, 2 Drawing Sheets

CURLING PREVENTION DEVICE OF THERMAL DEVELOPING MACHINE

BACKGROUND OF THE INVENTION

This invention relates to a device for preventing curling of a material derived from the thermal developing and/or transfer step in a thermal developing machine.

Concerning the diffusion transfer type thermal developing in which a diffusible dye is released by thermal developing and the dye is transferred onto an image-receiving element to obtain a color image by separation of the recorded image and the dye, there have already been a large number of technical disclosures about light-sensitive elements, image-receiving elements, thermal developing methods and devices therefor. A typical example comprises passing an image-receiving element and a thermal developing light-sensitive element superposed on one another with the dye fixing layer surface and the light-sensitive layer surface faced to each other between a pair of rollers capable of effecting uniform heating and pressurization.

Next, both of the superposed elements are heated uniformly to effect thermal developing and have the dye which is released from the thermal developing light-sensitive element by thermal developing, transferred onto the dye fixing layer, and then the above two sheets can be peeled off to form an image on the image-receiving element.

In this method, when the superposed light-sensitive element and the image-receiving element are subjected to thermal developing transfer, the superposed state is required to be maintained for a predetermined period of time, and therefore it has been considered to pass the light-sensitive element and the image-receiving element linearly between a pair of flat belts. Also, it is considered to pass them between a drum and a belt opposed thereto.

On the other hand, a thermally developing light-sensitive material is used according to the present invention which is different from the type requiring superposing the light-sensitive element and the image-receiving element on one another as described above. In particular an integral type thermal developing light-sensitive material (thermal developing light-sensitive material having at least a light-sensitive layer, a white reflective layer and an image-receiving layer on the same support) may be also employed. As to such integral type thermal developing light-sensitive materials, they are shown in, for example, Japanese Unexamined Patent Publication No. 80,148/1986; and Japanese patent application No. 254,257/1986 "(Title: Mono-sheet type thermal developing light-sensitive material, Applicant: Konishiroku Photo Industry K. K., Filing date: Oct. 25, 1986. Japanese patent application No. 254,257/1986 was published as Japanese Unexamined Patent Publication No. 108,337/1988 (published May 13, 1988).

The basic layer constitution of the integral type thermal developing light-sensitive material has a subbing layer, a light-sensitive layer (having 1 or 2 or more layers, and may have an intermediate layer when having two or more layers), a white reflective layer, an image-receiving layer and a protective layer in this order mentioned from the support.

Also in the case of such integral type thermal developing light-sensitive material, except for requiring no superposing mechanism, thermal developing transfer can be effected by the same device as described above to form an image on the image-receiving layer.

Anyway, for thermal developing transfer, it is requested to maintain both elements or the integral type thermal developing light-sensitive material at a certain high temperature state for a predetermined time. The system considered for such heating is generally the system to press the heat block against at least one belt in the belt-belt type of the former, while it is the system of using a heated drum as the drum in the drum-belt type of the latter.

The drum-belt type as mentioned above is better in thermal developing transfer processability as compared with the belt-belt type.

More specifically, in this type, the respective elements are conveyed under a superposed state between the drum and the belt. Therefore, tension of the belt acts uniformly on the whole opposed surface with the belt, whereby uniform pressing is possible to give uniform adhesion between the both elements and enhance easily the adhesive force in proportion to the tension, which is particularly suitable in the case of thin element thickness. Also, since the respective elements lie along the curvature of the drum surface, they are excellent in running performance and will not go apart from the drum. For such reasons, generation of transfer irregularity can be prevented.

Also by using a heated drum as the drum, in the conveying process, the material can be directly heated, whereby heating characteristic can be also excellent.

However, according to this system, since the conveying passage is shaped in an arc and also heat is given in the conveying process, the material is delivered from the thermal developing transfer step under a state substantially along its arc, and the curling cannot be remedied even after elapse of time.

Also, even in the case of passing a material on a plane as in the belt-belt type, curling will occur when the elongation degree by heating between the light-sensitive sheet and the image-receiving sheet is different.

If there is such curling, when piling on a stocker with both sheets separated from each other, piling difficulties may be brought about, or commercial product value may be significantly lowered.

SUMMARY OF THE INVENTION

Accordingly, a primary object of the present invention is to provide a device which can correct curling which has occurred in the thermal developing transfer step.

The above object can be accomplished by providing at the outlet of thermal developing and/or transfer step and thereafter a correcting guide passage having a bend in the opposite direction to the direction of curling appearing in said step, and adapting said device to permit a thermal developing light-sensitive material to pass with a temperature of 50° C. at least at the inlet portion of the correcting guide passage.

DESCRIPTION OF THE PREFERRED EMBODIMENTS

Figure 1:
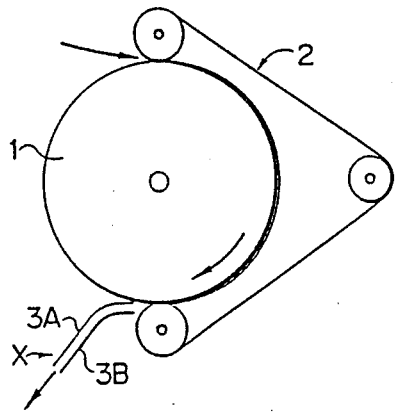
FIG. 1 is a schematic illustration showing a first example of the device according to the present invention.

The present invention is also applicable to an integral type mono-sheet thermal developing light-sensitive material, as the thermal developing light-sensitive material, other than the two-sheet type in which a light-sensitive element and an image-receiving element are superposed on one another.

A typical example of the thermal developing transfer step may be of the drum-belt type, and the belt-belt type having positive and negative bends, but the present invention is also applicable for the belt-belt type which passes on one flat plane. This is because, even if it may pass on one flat plane, due to the difference in elongation degree between the sheets, or due to the difference in elongation degree between the support and the layer portion thereon even in the case of an integral type mono-sheet, curling will occur. Therefore, it may be of the current passage heating system in which electrodes are arranged at the upstream and downstream portions and current is passed between those electrodes.

However, in the following description, the drum-belt type is primarily described, and only some comments are given on other thermal developing systems themselves, of which basic portions are known in the art.

Now, the drum-belt type thermal developing transfer device is constituted by arranging at least one conveyor belt wound around rollers as opposed to one drum so that the belt may lie along its surface so as to convey a light-sensitive material (light-sensitive element and image-receiving element) under a superposed state between the drum and the belt, and the belt is tensioned in the conveying region to press the belt against the drum side through its tension.

The heat by thermal developing transfer should be preferably given by the heating drum with a heater built in the drum, but it is also possible to give heat to the light-sensitive material with the belt as the heat-transmitting member by providing an arc-shaped heater on the back of the belt, or to permit the thermal developing transfer device as a whole to exist within a heated chamber.

In such thermal developing transfer device, the light-sensitive material is generally curled in the bending direction of the drum, and for prevention of such curling, a curling correcting guide passage is provided immediately after the device.

The correcting guide passage is made to have a bend in the opposite direction to the curling direction. In this case, the curvature of the guide passage may be uniform from its inlet to outlet, but since flattening is finally desired, the curvature of the front portion of the guide passage should be preferably made smaller with the curvature of the rear portion greater, or the curvature may be gradually increased toward the outlet.

Leading from the thermal developing transfer device to the correcting guide passage may be done by means of an appropriate guiding means. The correcting guide passage can be constituted of a pair of guide faces which covers at least the width of the material, i.e. an effective width, for example, a pair of opposed curved guide plates or opposed guide blocks. In this case, for aiding conveyance of the light-sensitive material, conveying rollers may be also provided at appropriate positions, for example, at the inlet and the outlet. Also, the correcting guide passage may be also constituted of the drum and a guide plate placed apart therefrom along the curved surface thereof. Further, along the curved line, a number of sets of roller pairs may be also arranged.

In using the correcting guide, even though opposite curling is imparted, after the material has been cooled curling correction cannot be made and also the laminate will be peeled off, and therefore the temperature at least at the inlet portion of the correcting guide passage is desired to be 50° C. or higher. In this case, if the temperature is higher than the thermal developing temperature T °C., thermal developing will proceed, and therefore the temperature should be preferably made lower than that temperature.

In heating such material, there can be used a means to provide a curved heater along the correcting guide passage, to use a heating drum with a heater built-in in the case of providing a drum, or to place the correcting guide passage under a heated atmosphere. A current passage heating system may be also available.

During passing through the correcting guide passage, the heat possessed by the material should be preferably removed at the latter half portion of the correcting guide passage, or after it exists from the outlet with respect to prevention of recurling, etc. As such means, a cooling fan blasting cooling wind against the material may be employed. In cooling, if there is a temperature distribution in the width direction of the material, there is the fear of curling at the side portion, and therefore the blowing outlet of cooling wind should be preferably extended with an uniform opening in the width direction.

The position where the correcting guide passage is arranged may not be immediately after the thermal developing transfer device. For example, when having a peeling means to peel off the light-sensitive element from the image-receiving element, it may be provided downstream of the peeling means for curling correction of the image-receiving element.

Also, the conveying speed of the material in the curling correcting passage may be the same in the thermal developing transfer step, but within the speed range in which curling correction can be normally effected, a speed different from that of the thermal developing and/or transfer step may be also employed.

Referring now to some embodiments, the present invention is described in more detail.

EXAMPLE 1

The embodiment shown in FIG. 1 performs thermal developing transfer by the heat from the heating drum 1, while permitting a material to pass between the heating drum 1 and the conveyor belt opposed thereto, and on the outlet side of the thermal developing transfer device, there is provided a correcting guide passage X with a pair of opposed curved guide plates 3A, 3B with smaller curvature at the inlet portion and greater curvature at the outlet portion. The material passes through the guide passage X in a state having sufficient residual heat.

EXAMPLE 2

Figure 2:
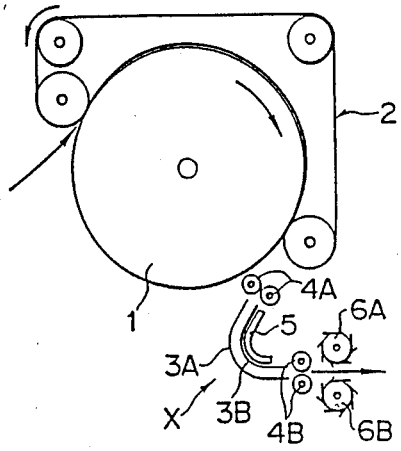
FIG. 2 is a schematic illustration showing a second example of the device according to the present invention.

The embodiment shown in FIG. 2 is basically the same as the embodiment in FIG. 1, but for making delivery of the material smooth, delivery rollers 4A, 4B are provided at the inlet and outlet of the correcting guide passage, and also a curved heater plate 5 is provided along the bend of the guide passage X with a pair of opposed curved guide plates 3A, 3B, and further cylindrical cooling fans 6A, 6B are arranged at the position after the outlet of the guide passage X.

EXAMPLE 3

Figure 3:
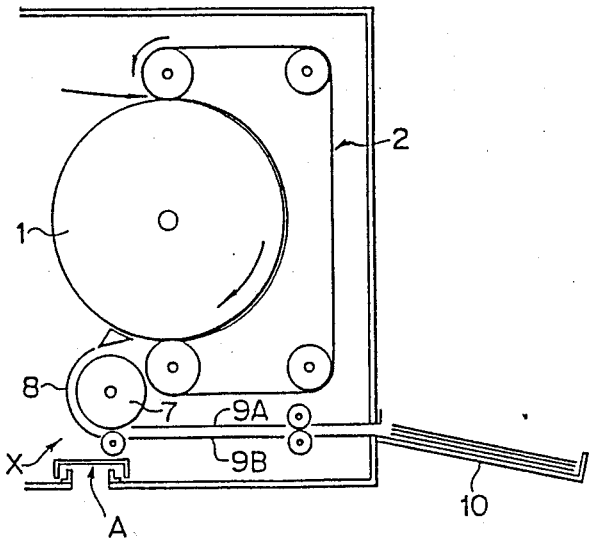
FIG. 3 is a schematic illustration showing a third example of the device according to the present invention.

FIG. 3 shows an embodiment in which a correcting guide passage X is constituted of a combination of the heating drum and the curved guide plate 8 as the preceding process portion, and a pair of opposed flat guide plates 9A, 9B as the succeeding process portion. An air inhalant portion A of a structure which is designed to obstruct light is provided near the guide passage X, and an air exhaust portion (not shown) of a structure which is designed to obstruct light is provided other preferred part. The material discharged from the guide passage X is piled on a stocker 10, and thereafter at convenient time point, peel-off between the light-sensitive element and light-receiving element is done by man power, etc.

EXAMPLE 4

Figure 4:
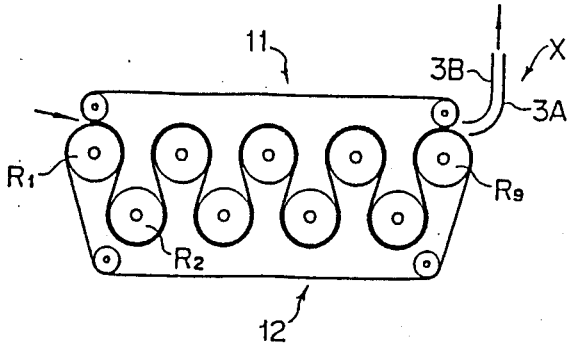
FIG. 4 is a schematic illustration showing a fourth example of the device according to the present invention.

FIG. 4 shows an embodiment in which a correcting guide passage X is constituted at the outlet of a thermal developing device constituted by arranging a pair of conveyor belts 11, 12 with positive and negative bends and having heaters built in the multiple roll group $R_1$, $R_2$, . . . $R_9$. The correcting guide passage X consists of a pair of opposed curved guide plates 3A, 3B.

EXAMPLE 5

Figure 5:
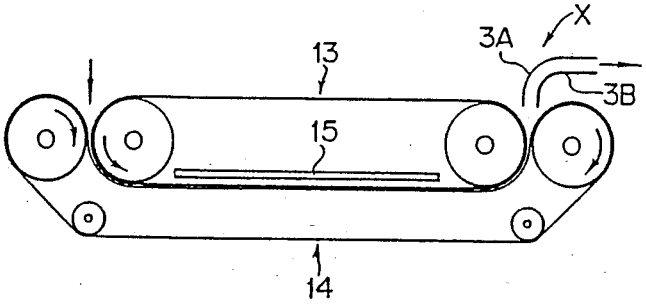
FIG. 5 is a schematic illustration showing a fifth example of the device according to the present invention.

FIG. 5 shows an embodiment in which a correcting guide passage X with a pair of opposed curved guide plates 3A, 3B is provided at the outlet of the conveyor belts 13, 14 which are substantially in parallel to each other. 15 denotes a heating plate.

EXAMPLE 6

Figure 6:
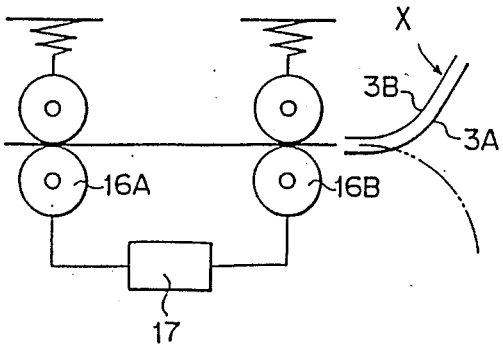
FIG. 6 is a schematic illustration showing a sixth example of the device according to the present invention.

FIG. 6 shows an embodiment in which a correcting guide passage X with a pair of opposed curved guide plates 3A, 3B is provided at the outlet of a thermal developing transfer device according to the current passage heating system to heat the material by passing direct current or alternating current from a power source 17 through a material which is electroconductive and generates heat by current passage such as a material containing carbon black with the rollers 16A, 16B as electrodes. In this case, although the material is linearly delivered between the rollers 16A, 16B, correction is intended to be effected for the material which will exhibit curling as shown by the presumed line in the case of no correction due to difference between the both elements in elongation degree by heat through the correcting guide passage X.

The light-sensitive element in the present invention can be obtained by coating and drying materials containing a dye donating polymer, silver halide, organic silver salt in a hydrophilic binder as the binder on a support.

On the other hand, the image-receiving element can be obtained by coating an image-receiving layer containing a polymer for fixing the heat-transferable dye migrated by diffusion from the thermal developing light-sensitive element in the above light-sensitive element or on a support such as paper or other synthetic polymer sheet, etc.

The image-receiving layer of the image-receiving element effectively used may have the function of receiving the dye in the thermally developed light-sensitive layer released or formed by thermal developing, such as polymers containing tertiary amine or quaternary ammonium salt, as disclosed in U.S. Pat. No. 3,709,690. For example, there are polymers containing ammonium salts, polymers containing tertiary amines, etc. A typical image-receiving layer for diffusion transfer may be obtained by coating a mixture of a polymer containing ammonium salt, tertiary amine, etc. with gelatin or polyvinyl alcohol, etc. on a support. As another useful dye-receiving substance, those formed of heat-resistant high polymeric organic substances having a glass transition temperature of 40° C. or higher and 250° C. or lower as disclosed in Japanese Unexamined Patent Publication No. 207250/1982, etc. may be employed.

These polymers may be carried as the image-receiving layer on a support, or themselves used as the support.

As the support for light-sensitive element and image-receiving element, either transparent or opaque support may be used. For example, there may be included films such as polyethyleneterephthalate and supports containing pigments such as titanium oxide in these supports, baryta paper, RC paper having a thermoplastic resin containing a pigment laminated on paper, coated paper, cloth paper, glasses, metals such as aluminum, etc. or supports obtained by coating and curing of an electron beam curable resin composition containing a pigment on these supports, and supports having coated layer containing a pigment provided on these supports, etc.

As the imagewise exposure method for recording latent images onto the thermal developing light-sensitive element, there may be employed the whole surface exposure method as in conventional color printer, or alternatively exposure may be effected by scanning exposure through photoconversion of the data of a computer or video signals.

Accordingly, as the light source, generally tungsten lamp, mercury lamp, halogen lamp such as iodine lamp, etc., or otherwise CRT, FOT, LED, laser, etc. may be employed.

In the case of a thermal developing light-sensitive material which is not of the integral type, adhesion between the light-sensitive element and the image-receiving element is important in obtaining a transferred image of good quality. Adhesion is required to be adhered without irregularity as a matter of course, and also with a predetermined pressure, namely a pressure of 0.1 kg/cm$^2$ or higher.

The heating temperature required for the heating step for thermal developing, thermal transfer should be preferably in the range of 80° C. to 250° C., more preferably 100° C. to 200° C., and the time may be preferably 0.1 sec. to 300 sec., more preferably 5 sec. to 18 sec., and the optimum temperature is determined depending on the respective temperatures.

As described above, according to the present invention, curling derived from the thermal developing transfer step can be corrected, and lowering in conveyability of the material thereafter and commercial product value after completion of the treatment can be prevented.

We claim:

1. A device for the prevention of curling in a thermal-developing, light-sensitive material passed through a thermal developing machine having means for subjecting said material to a thermal developing operation which results in curling said material to bend in a certain arc, said device comprising:

a correcting guide passage adapted to be positioned at an outlet of a thermal developing means and to receive material as it exits therefrom, said correcting guide passage having at least a portion thereof bent in an arc opposite to an arc of said material, and means for controlling the temperature of said material as it enters said correcting guide passage from the outlet of said thermal developing means to be at least 50° C. and lower than a thermal developing temperature of said material.

2. A curling prevention device of a thermal developing machine according to claim 1, wherein the correcting guide passage is formed of a pair of opposed guide faces which covers at least the width of the material.

3. A curling prevention device of a thermal developing machine according to claim 2, wherein the correcting guide passage has a smaller radius of curvature at its inlet side and a greater curvature at its outlet side.

4. A curling prevention device of a thermal developing machine according to claim 2, wherein the correcting guide passage is gradually increased in its radius of curvature from the inlet side toward the outlet side.

5. A curling prevention device of a thermal developing machine according to claim 1, wherein the temperature controlling means includes a heating means in the correcting guide passage for heating the material passing through the correcting guide passage.

6. A curling prevention device of a thermal developing machine according to claim 5, wherein the correcting guide passage has conveying rollers at the inlet and the outlet.

7. A curling prevention device of a thermal developing machine according to claim 1, wherein the correcting guide passage has conveying rollers at the inlet and the outlet.

8. A curling prevention device of a thermal developing machine according to claim 1, wherein the temperature controlling means includes cooling means in the correcting guide passage for cooling the material at the latter half portion or at the outlet or thereafter of the correcting guide passage.

9. A curling prevention device of a thermal developing machine according to claim 1, wherein the temperature controlling means includes cooling means in the correcting guide passage for cooling the material at the latter half portion or at the outlet or thereafter of the correcting guide passage.

10. A curling prevention device of a thermal developing machine according to claim 1, wherein the temperature controlling means includes a heating drum with a heater built in and a guide plate placed apart therefrom along the curved surface thereof, said heating drum and guide place forming the correcting guide passage.

* * * * *